US012709899B2

(12) United States Patent
Andersen et al.

(10) Patent No.: US 12,709,899 B2
(45) Date of Patent: Aug. 18, 2026

(54) FLASHING ASSEMBLY FOR USE BETWEEN TWO ROOF WINDOWS MOUNTED IN AN INCLINED ROOF STRUCTURE, A GROUP OF ROOF WINDOWS MOUNTED USING SUCH A FLASHING ASSEMBLY, AND A METHOD FOR MOUNTING A FLASHING ASSEMBLY BETWEEN TWO ROOF WINDOWS

(71) Applicant: VKR Holding A/S, Hørsholm (DK)

(72) Inventors: Rasmus Andersen, Sunds (DK); Jens-Ulrik Holst Henriksen, Arhus V (DK); Kristian Strand Grønbæk, Gedved (DK); Jakob Swane Lund, Hørsholm (DK); Bjarne Andrés Andersen, Hillerød (DK); Birgit Schmidt, Viby J (DK)

(73) Assignee: VKR Holding A/S (DK)

( * ) Notice: Subject to any disclaimer, the term of this patent is extended or adjusted under 35 U.S.C. 154(b) by 217 days.

(21) Appl. No.: 18/626,522

(22) Filed: Apr. 4, 2024

(65) Prior Publication Data

US 2024/0337108 A1 Oct. 10, 2024

(30) Foreign Application Priority Data

Apr. 5, 2023 (DK) ..... PA 2023 70172

(51) Int. Cl.
*E04D 13/14* (2006.01)
*E04D 13/03* (2006.01)
*E04D 13/147* (2006.01)

(52) U.S. Cl.
CPC ..... *E04D 13/147* (2013.01); *E04D 13/031* (2013.01)

(58) Field of Classification Search
CPC .. E04D 13/147; E04D 13/031; E04D 13/1475
See application file for complete search history.

(56) References Cited

U.S. PATENT DOCUMENTS 4,543,753 A * 10/1985 Sonneborn ..... E04D 13/1475 52/211
5,065,553 A 11/1991 Magid

FOREIGN PATENT DOCUMENTS

DE 2910610 A1 3/1979
DK 154099 10/1988
(Continued)

OTHER PUBLICATIONS

Extend Search Report dated Jul. 19, 2024 issued in connection with European Patent Application No. 24168726.8, eight (8) pages.
(Continued)

*Primary Examiner* — Patrick J Maestri
(74) *Attorney, Agent, or Firm* — Merek, Blackmon & Voorhees, LLC

(57) ABSTRACT

A flashing assembly for use between two roof windows mounted in an inclined roof structure, a group of roof windows mounted using such a flashing assembly, and a method for mounting a flashing assembly between two roof windows. In the flashing assembly (1), the first section (71) of the first flashing element (7) comprises two legs (711, 712) extending along the width axis and being located at a distance from each other measured along the height axis thereby forming a pocket (713) between them. The first section (81) of the second flashing element (8) fits into the pocket of the first flashing element.

20 Claims, 12 Drawing Sheets

(56) References Cited

FOREIGN PATENT DOCUMENTS

| | | | |
|---|---|---|---|
| EP | 0087647 | B1 | 4/1985 |
| EP | 1550777 | | 7/2005 |
| EP | 1581707 | B1 | 10/2009 |
| EP | 1521888 | | 11/2010 |
| EP | 2481864 | | 8/2012 |
| EP | 3061886 | A1 | 8/2016 |
| EP | 3480388 | | 5/2019 |
| FR | 2916464 | | 11/2008 |
| PL | 217499 | B1 | 7/2014 |
| PL | 226250 | B1 | 6/2017 |
| PL | 70359 | | 11/2018 |
| SE | 416072 | B | 11/1980 |
| WO | WO95/28535 | | 10/1995 |
| WO | WO03/074812 | | 9/2003 |
| WO | WO2020/071932 | A1 | 4/2020 |

OTHER PUBLICATIONS

Machine translation of FR2916464.
U.S. Appl. No. 18/621,211, filed Mar. 29, 2024.
U.S. Appl. No. 18/625,691, filed Apr. 3, 2024.
European Search Report dated Sep. 10, 2024 that issued in connection with European Patent Application No. 24168729.2.
European Search Report dated Sep. 3, 2024 that issued in connection with European Patent Application No. 24166292.3.
Machine translation of description of PL217499B1.
Machine translation of description of SE416072B.
Machine translation of PL226250B1.
Machine translation of DE2910610A1.

* cited by examiner

FLASHING ASSEMBLY FOR USE BETWEEN TWO ROOF WINDOWS MOUNTED IN AN INCLINED ROOF STRUCTURE, A GROUP OF ROOF WINDOWS MOUNTED USING SUCH A FLASHING ASSEMBLY, AND A METHOD FOR MOUNTING A FLASHING ASSEMBLY BETWEEN TWO ROOF WINDOWS

A flashing assembly for use between two roof windows mounted in an inclined roof structure, a group of roof windows mounted using such a flashing assembly, and a method for mounting a flashing assembly between two roof windows

TECHNICAL FIELD

The present invention relates to a flashing assembly for use between two roof windows, which are mounted side by side in an inclined roof structure and which each comprises a frame and a pane element, said flashing assembly comprising a first flashing element configured for extending along a frame member of the frame of a first roof window and a second flashing element configured for extending along a frame member of the frame of a second roof window, each flashing element comprising a first section and a second section, said first section extending along a width axis of the flashing element, being configured for extending between the first roof window and the second roof window, and having an interior side configured for facing the roof structure, and said second section extending in an exterior direction along a height axis of the flashing element and having an interior side configured for facing the frame of one of the roof windows, said second section having a first edge at the first section and a second edge located at a distance from the first section measured along the height axis. The invention further relates to a group of roof windows mounted using such a flashing assembly, and to a method for mounting a flashing assembly between two roof windows.

Background Art

When installing windows in a roof, it is vital to ensure that the joints between roof structure and the roof windows are tight. For this purpose, a flashing assembly comprising a plurality of flashing elements each extending over the roof structure and up along outer sides of the frames of the roof windows, thus covering any gaps between the roof structure and roof windows, is used. While the flashing elements used along outer sides of the roof windows facing the roof structure may be of a fairly simple construction, the flashing elements used along outer sides facing another roof window need to fit into the space available between the roof windows and a tight fit between them must be ensured to prevent that water penetration.

In DK154099 this was achieved by the first sections of the flashing elements being provided with flanges projecting in an exterior direction away from the interior side of the first sections and by arranging a cover member having flanges projecting in an opposite interior direction, so that it rode on the flanges of the flashing elements. An intermediate member was used to keep the flashing element from moving towards each other, once the flashing assembly had been mounted. While this flashing assembly worked well with respect to water proofing, the cover member takes up space in the gutter formed between the two roof windows, and the width of the flashing assembly needs to match the distance between the roof windows.

A flashing assembly, which is able to compensate for variations in the distance between the roof windows, is known from WO03/074812A1. Here the first sections of the two flashing elements are interconnected in a manner allowing different mutual positions of the flashing elements along the width axis. If only a small adjustment of the mutual positioning is necessary, for example to compensate for imprecision in the mounting of the roof windows, the first sections are interconnected for example by bent edges of the first sections hooking into each other and allowing a telescopic movement. To compensate for larger differences in the distance between the roof windows, the first sections are provided with profiling, such as hollow longitudinal ribs fitting over each other, allowing the first sections to fit over each other in at least two different ways. In this manner, the flashing elements have at least two predefined mutual positions, giving the flashing assembly at least two different configurations suitable for use when the two roof windows are mounted either close to each other or further apart, depending for example on the width of rafters of the roof structure. It, however, remains a problem that each of the flashing assemblies disclosed in WO03/074812A1 can either only be used for a limited number of predefined mutual distances between the roof windows or within a limited distance interval.

SUMMARY OF INVENTION

With this background, it is therefore an object of the invention to provide a flashing assembly and a method for mounting a flashing assembly between two roof windows by which one and the same flashing assembly can be used for a wide range of mutual distance so that it can be used both with roof windows mounted close to each other and further apart and at the same be time capable of compensating for smaller variations.

In a first aspect of the invention, this and further objects are achieved with a flashing assembly of the kind mentioned in the introduction which is furthermore characterised in that the first section of the first flashing element comprises two legs extending along the width axis and being located at a distance from each other measured along the height axis thereby forming a pocket between them, and that the first section of the second flashing element fits into the pocket of the first flashing element. By sliding the first section of the second flashing element into and out of the pocket in the first section of the first flashing element in a telescopic manner, the width of the flashing assembly can be adjusted in a stepless manner within a broad interval. The minimum width of the interval is defined by the width of the first section of the second flashing element and the depth of pocket and reached at full insertion into the pocket. The maximum width of the interval is defined by the sum of the widths of the first sections, minus an overlap needed to provide water tightness.

Due to the legs forming the pocket extending along the width axis, the bottom of the gutter formed by the flashing assembly will be substantially flat, which is not only an aesthetical advantage but also results in good draining properties.

In a second aspect of the invention, the above described and possibly further objects are achieved with a method for mounting a flashing assembly between two roof windows, which are mounted side by side in an inclined roof structure and which each comprises a frame and a pane element, said method comprising:

arranging a first flashing element so that it extends along a frame member of the frame of a first roof window with a first section extending between the two roof windows, with an interior side of the first section facing the roof structure, with a second section extending along a height axis in an exterior direction, and with an interior side of the second section facing the frame of the first roof window; and arranging a second flashing element so that it extends along a frame member of the frame of a second roof window with a first section extending between the two roof windows, with an interior side of the first section facing the roof structure, with a second section extending in an exterior direction, and with an interior side of the second section facing the frame of the second roof window;

wherein the first section of the second flashing element is inserted into a pocket of the first section of the first flashing element, said pocket being formed by two legs extending along a width axis and being located at a distance from each other measured along the height axis.

It is to be understood that any reference to the frame of roof window is not to be understood in the strictly limited literal sense of the term frame, but that it may include insulating material arranged on or around the frame and/or an underroof collar or other items used for the installation of the roof window in the roof structure.

In the following, embodiments of the invention will be described with reference to both aspects of the invention, and it is to be understood that an embodiment is not limited to a particular aspect unless explicitly stated.

One way of ensuring that a sufficient overlap between the first sections is maintained at all times is that the one of the two legs of the first section of the first flashing element located furthest from the second edge of the second section of the first flashing element has a flange projecting along the height axis in an exterior direction away from the interior side of the first section toward the other of the two legs, and that the first section of the second flashing element has a flange projecting along the height axis in an interior direction. When the two flashing elements are pulled away from each other along the width axes, such flanges may come into engagement with each other and prevent, or at least hinder, a further retraction. Thereby the flanges will ensure that the flashing assembly remains water-tight at all times.

The leg of the first flashing element located or extending furthest from the second edge of the second section of the first flashing element will be the one located closest to the roof structure and hence lowermost in the mounted state, and in the following it will therefore also be referred to as the lowermost leg.

In one embodiment, the flanges of the flashing elements each extends at an angle of more than 90 degrees in relation to the width axis so that they project back towards the respective second sections of the flashing elements. This may ease insertion of the second flashing element into the pocket of the first flashing element and/or allow the flanges to hook into each other thereby contributing to preventing unintended separation of the two flashing elements. Providing the flange on the first flashing element with an angle of more than 90 degrees may also contribute to preventing that any water reaching onto the lowermost leg of the first flashing element overflows and penetrates into the roof structure.

As is well known to the skilled person, flashing elements are typically made from sheet metal, such as aluminium or copper. In that case, the flashing elements, including any flanges, may then be made by bending as will be described in more detail below with reference to the drawing. It is to be understood the flashing elements being made from sheet metal does not necessarily means that they consist only of sheet metal. Paint or lacquer may be applied to protect the surfaces of the flashing elements and/or to give them a desired colour or other surface properties. Likewise, sealing material may be applied to ensure a tight connection with other members of the flashing assembly, with the roof windows, and/or with the roof structure.

Flanges made by bending of sheet metal may be bent back during insertion of the first section of the second flashing element into the pocket of the first flashing element as they come into contact with each other and will then snap back when they have passed each other. It is also possible to make one flange softer than the other, so that one gives way for the other. The flange on the second flashing element may alternatively or additionally have a height along the height axis, which is larger than the distance between the two legs of the first flashing element. In that case the flange on the second flashing element will press against both of the two legs when inserted in the pocket, thus providing a frictional resistance, which will hinder unintentional movement of the flashing elements in relation to each other.

It is presently considered advantageous that the minimum overlap between the first sections is 20 mm or more.

When mounting the flashing assembly, the first and second flashing elements may be interconnected before being arranged at the roof windows. The first section of the second flashing element may then initially be fully inserted into the pocket of the first flashing element and when the first sections are in contact with the roof structure, the two flashing elements are pulled away from each other until the second sections of both flashing elements have come into contact with the frames of the roof windows.

If the flashing assembly is not supplied in a preassembled state, it may be advantageous that the first flashing element is mounted before the second flashing element. This allows that first flashing element to be arranged in tight contact with the frame of the first roof window, before mounting the second flashing element. This may particularly be advantageous if the flashing elements are top flashing elements configured for extending along top frame member of the roof windows, bottom flashing elements configured for extending along bottom frame member of the roof windows, or gutter flashing elements configured for use between roof windows arranged above each other. Gutter flashing elements are for example used in an array of roof windows, where roof windows are arranged both side by side and above each other, such as in a two-by-two configuration. Such a configuration will require two top flashing elements, two gutter flashing elements, and two bottom flashing elements, four side flashing elements forming two flashing assemblies as described above and four separate side flashing elements.

Top flashing elements and bottom flashing elements are intended to extend along top frame members and bottom frame members of roof windows, i.e. along the frame members extending perpendicular to the inclination of the roof structure and being above and below the pane element as seen in the direction of inclination. Side flashing elements are the flashing elements extending between the top and bottom flashing elements in the direction of inclination or between a gutter flashing element and a top or bottom flashing element.

When the first flashing element is first arranged in contact with the frame of the first roof window, the first section of the second flashing element may be inserted fully into the pocket of the first flashing element, and the second flashing element may then it subsequently pulled back until the second section of the second flashing element comes into contact with the frame of the second roof window. This may contribute to facilitating a proper contact between the flashing element and the frames of the roof windows.

When the first flashing element is arranged first and the first section of the second flashing element is then inserted into the pocket of the first flashing element, the first section of the second flashing element may be bending during the insertion into the pocket. This is particularly considered advantageous when the flashing elements are top, bottom or gutter flashing elements, having a relatively large extend or extension along the width axes, as it allows the second flashing element to be swung into place as will be described in further detail below with reference to the drawing.

In roof windows installed in a so-called flush installed position, it is vital that sufficient room for insulation is provided on the outer side of the frame. In turn, this means that there is even less room for the flashing assembly than in roof windows not requiring such available room.

An additional advantage with the inventive flashing assembly in some embodiments is that the flashing assembly can be mounted sideways. In turn, this does not require a lot of space above/below roof windows, which is a considerable improvement when roof windows are mounted above each other.

With the invention, spacings between neighbouring roof windows ranging between at least 100 and 130 mm may be accommodated.

Other presently preferred embodiments and further advantages will be apparent from the subsequent detailed description and drawings.

A feature described in relation to one of the aspects may also be incorporated in the other aspect, and the advantage of the feature is applicable to all aspects in which it is incorporated.

BRIEF DESCRIPTION OF DRAWINGS

In the following description embodiments of the invention will be described with reference to the schematic drawings, in which.

DESCRIPTION OF EMBODIMENTS

Figure 1:
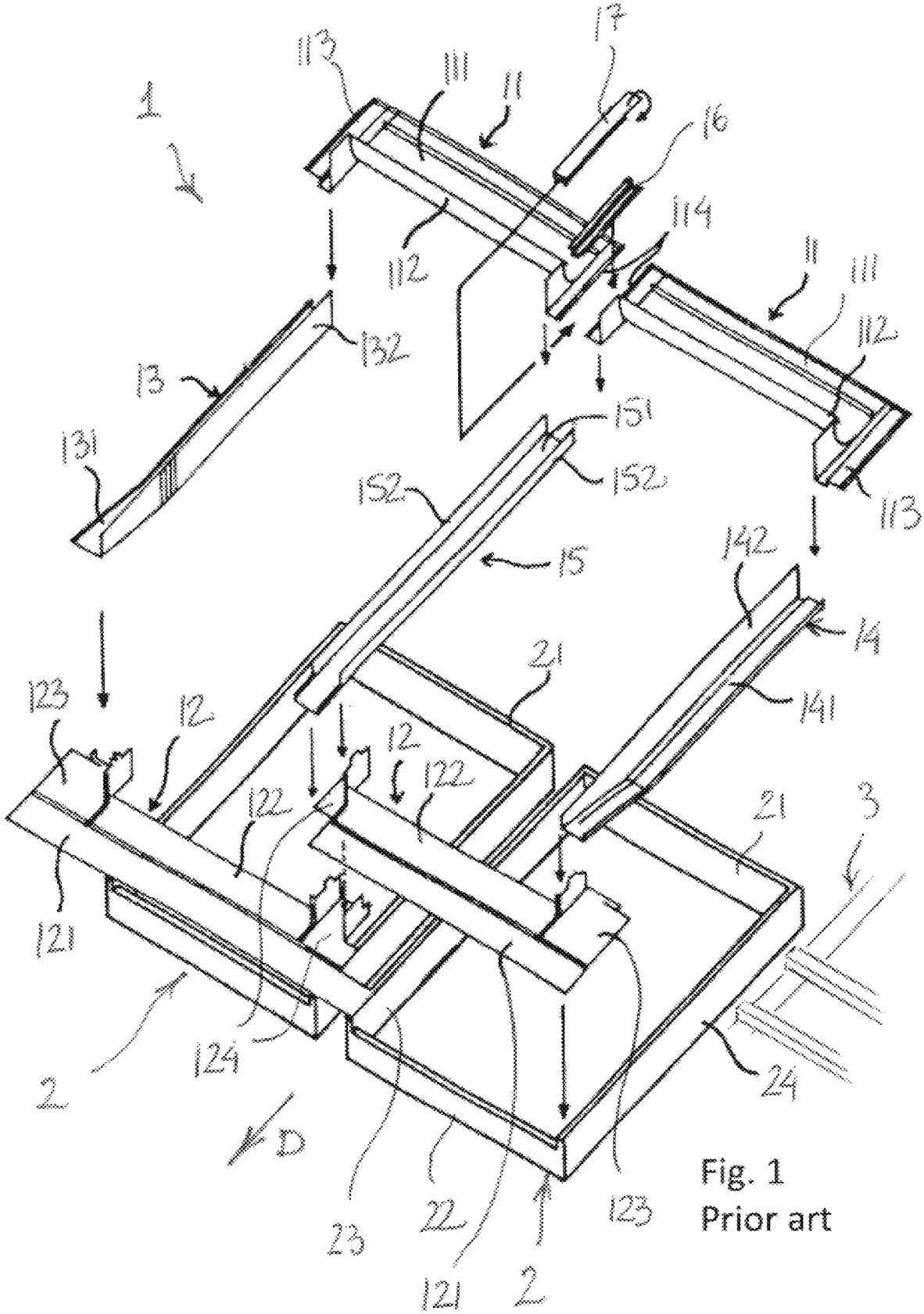
Fig. 1 Prior art
FIG. 1 is a perspective schematic view of two roof windows mounted side by side with a prior art flashing assembly, adapted by the incorporation of reference numerals corresponding to embodiments of the present invention.

Referring initially to FIG. 1, a prior art flashing assembly 1 for use with two roof windows mounted adjacent to each other side by side in a sloped roof structure 3 is shown. It is noted that the prior art figure has been adapted by the incorporation of reference numerals corresponding to embodiments of the present invention. As the construction of the roof windows are not of importance, they are here represented only by two frames 2, each comprising a top frame member 21 and a bottom frame member 22 both extending horizontally in the mounted state and two side frame members 23, 24 extending in a slope direction of the roof structure in the mounted state. Likewise, the roof structure 3 is represented only by a single rafter and a few laths and the slope direction is indicated by the arrow D. For a reference to other orthogonal directions as defined in the present application, namely a width direction W and a height direction H, see FIG. 5.

The flashing assembly 1 comprises two top flashing elements 11 each configured for extending along a top frame member 21, two bottom flashing elements 12 each configured for extending along a bottom frame member 22, two side flashing elements 13, 14 each configured for extending along a side frame member 23, 24, and a middle gutter flashing element 15 configured for extending between the two roof windows. Common to all flashing elements is that they comprise an outer portion 111, 121, 131, 141, 151 configured for extending substantially in plane with the roof structure and at least one inner portion 112, 122, 132, 142, 152 configured for extending up along a frame member of a roof window.

The top flashing elements 11 and the bottom flashing elements 12 are provided with corner sections, 113, 114, 123, 124 configured for establishing an overlap with the side flashing elements 13, 14 and the middle gutter flashing element 15, and cover members 16, 17 are provided for interconnecting the corner sections 114 of the top flashing elements above the middle gutter flashing element.

In FIG. 1, the flashing assembly 1 is configured for use with roof windows mounted deep in a roof structure, and the side flashing elements 13, 14 are configured for use at a left-hand side frame member 23 and at a right-hand side flashing element 14 of a roof window, respectively. The same applies to the two top flashing elements 11 and the two bottom flashing elements 12.

Figure 2:
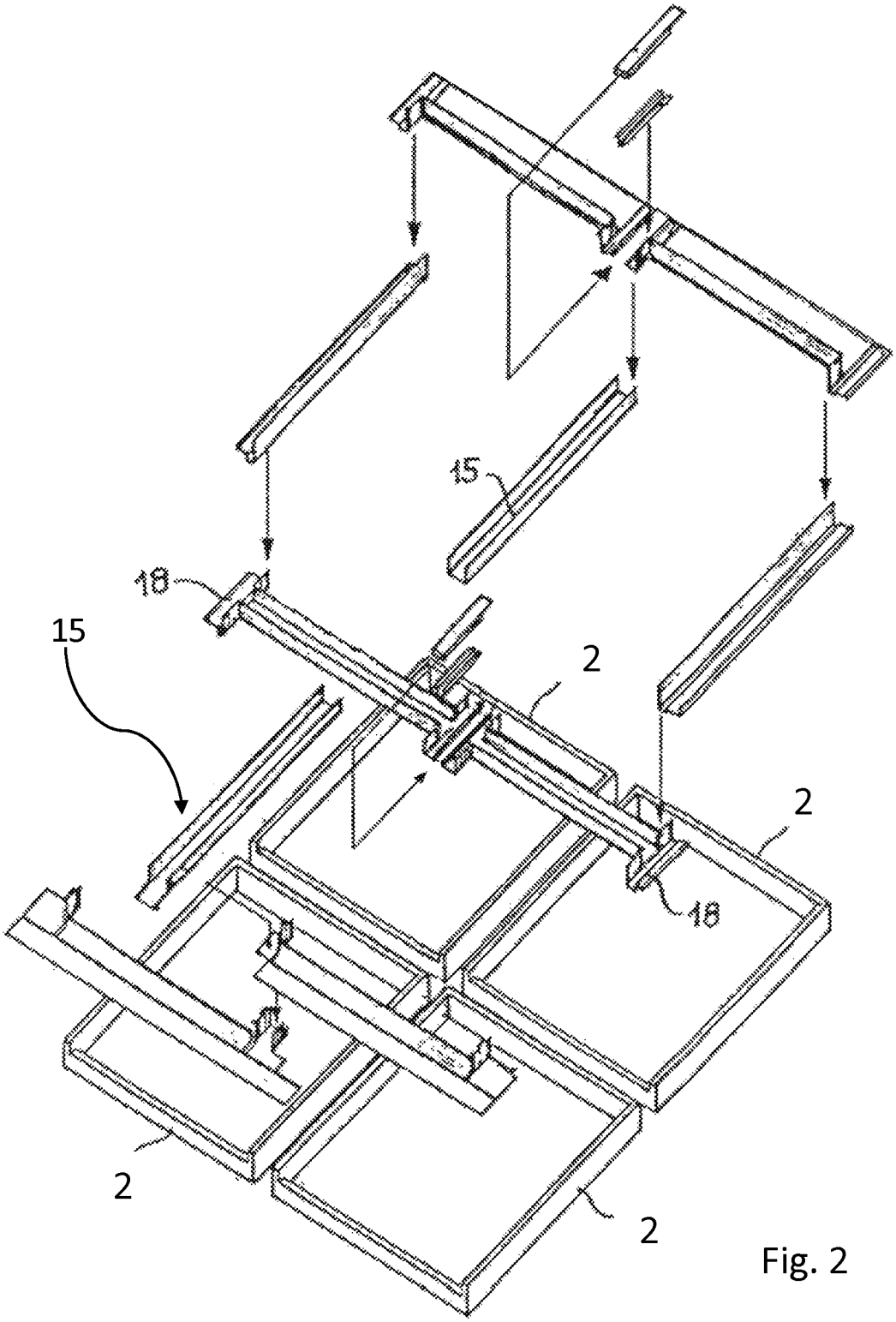
FIG. 2 is a perspective schematic view of four windows mounted two by two in a matrix configuration, adapted only by the incorporation of a few reference numerals corresponding to embodiments of the present invention.

In FIG. 2 a corresponding flashing assembly for four roof windows mounted in a two-by-two configuration is shown. It includes two middle gutter flashing elements 15 corresponding to the one in FIG. 1 and extending between the two columns of roof windows, and two drainage gutter elements 18 extending horizontally between the two rows of roof windows.

Figure 3:
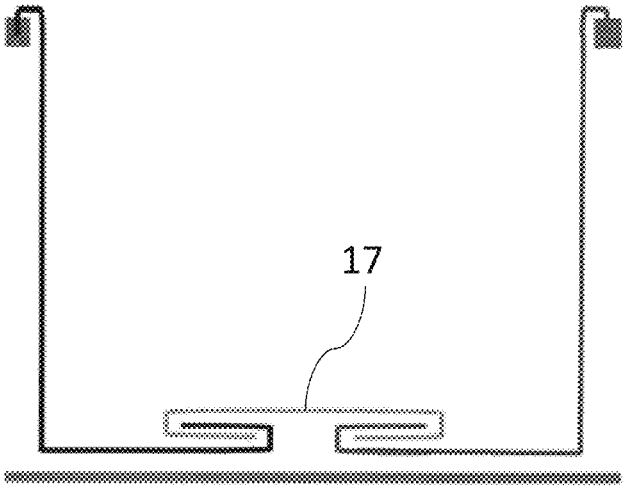
Fig. 3 Prior art
FIG. 3 is a sketch showing general engagement means by a separate connection piece.

FIG. 3 shows a sketch of general engagement means between two elements making use of a separate cover member.

In the following description of embodiments of the invention, reference numerals as per the above will be applied for components having the same or analogous function. This is not and should not be seen as a concession to such components being identical to components of the prior art.

Figure 4:
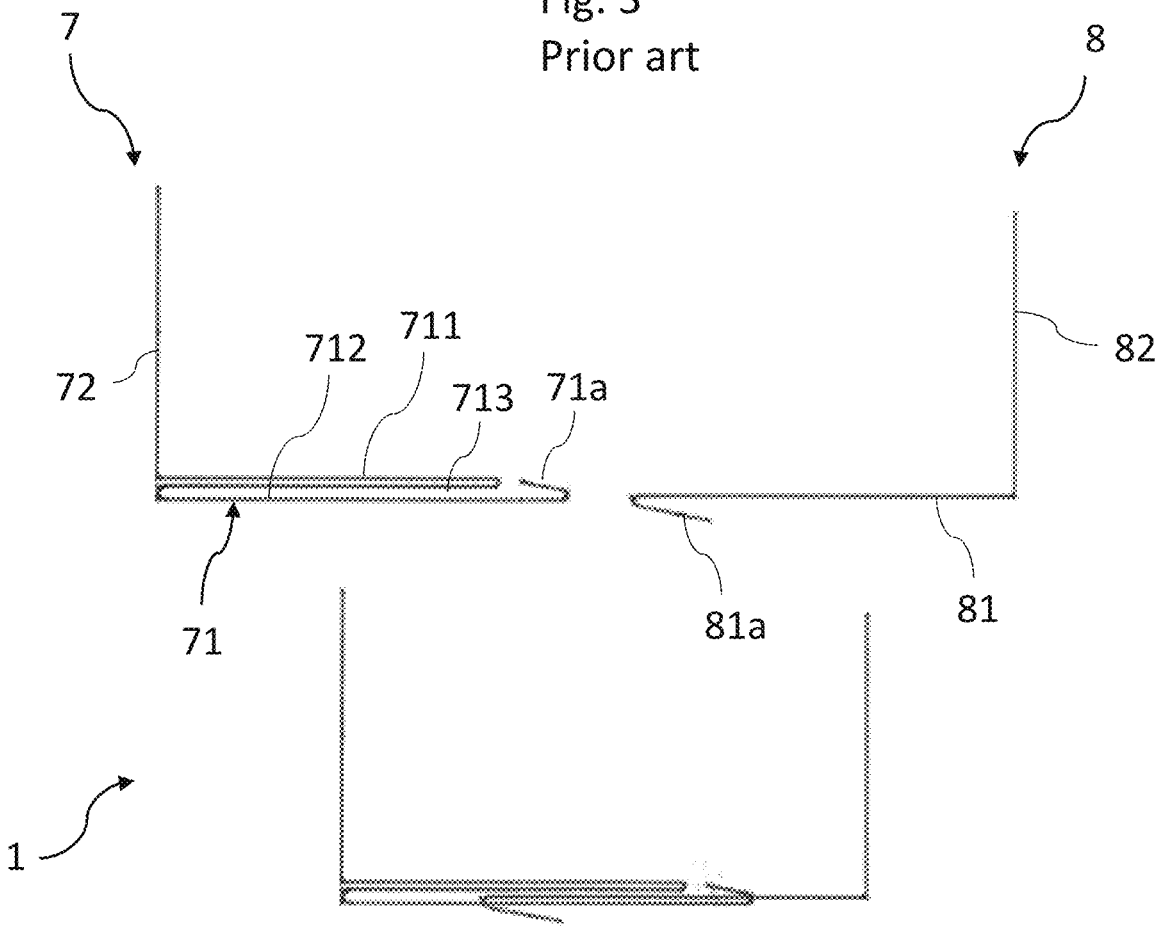
FIG. 4 is a view of the engagement between flashing elements in an embodiment of the flashing assembly according to the invention.
Figure 5:
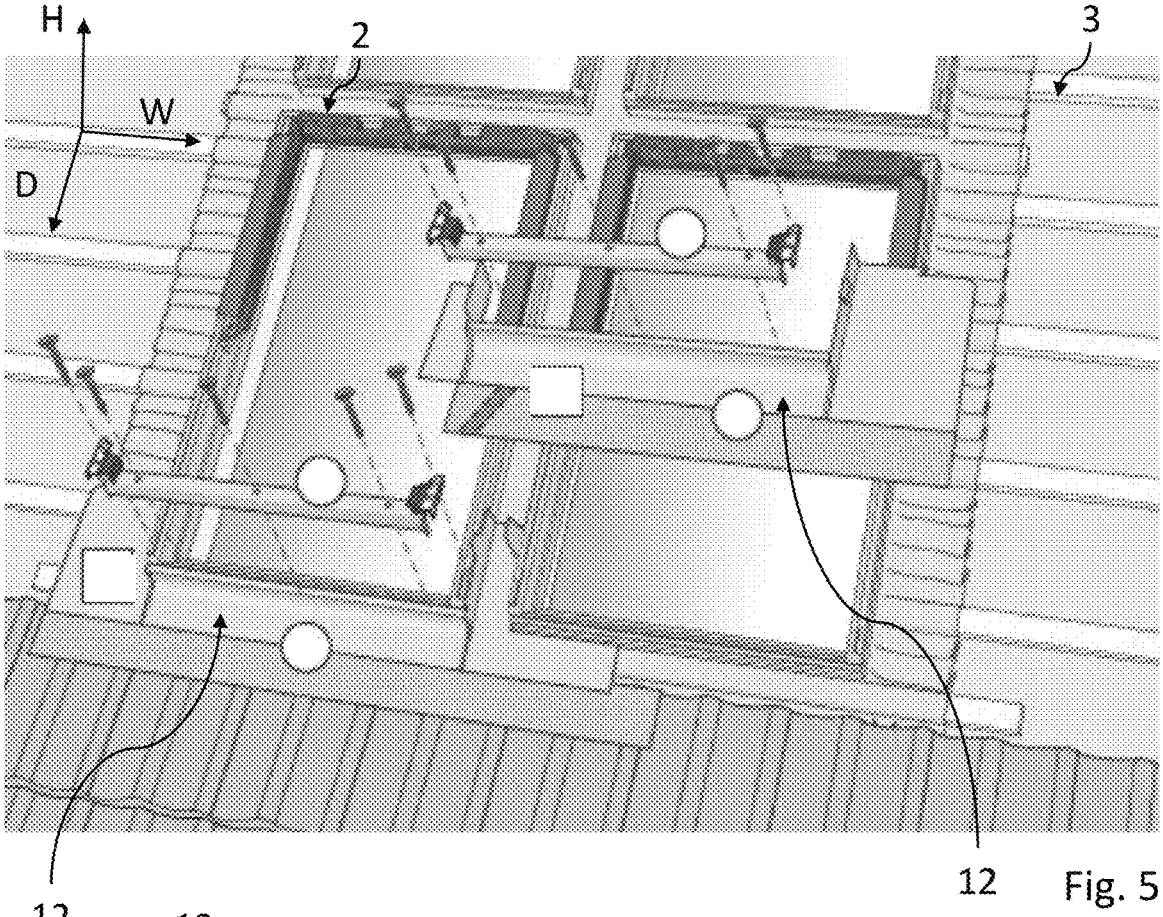
FIGS. 5-8 are perspective views depicting steps in a method for mounting a flashing assembly.
Figure 6:
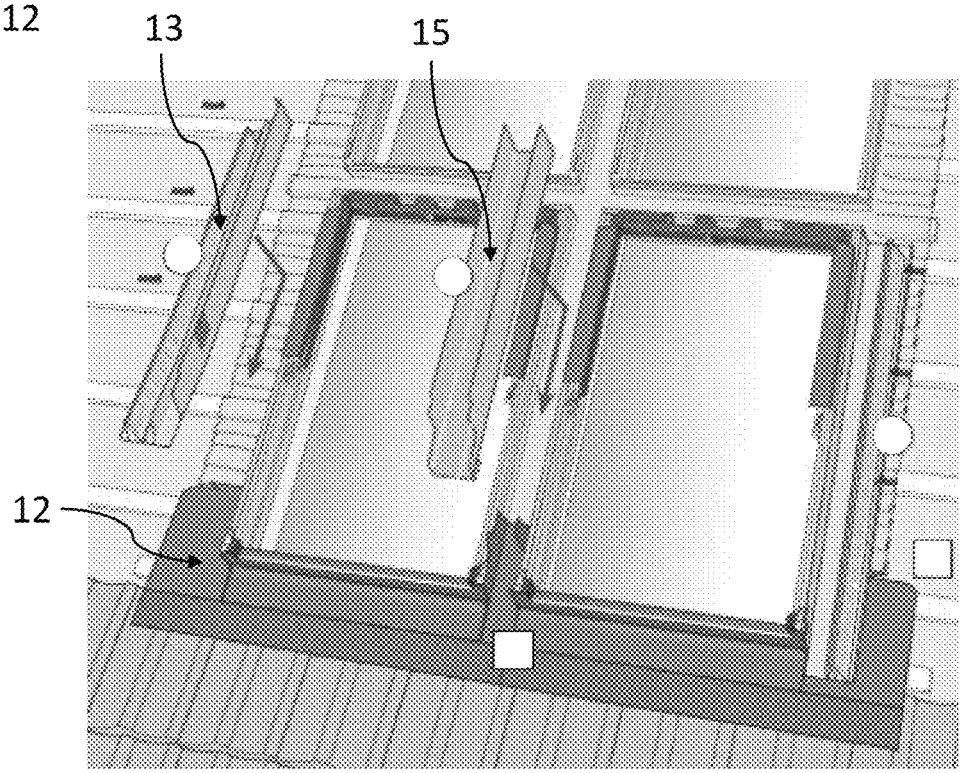
Figure 7:
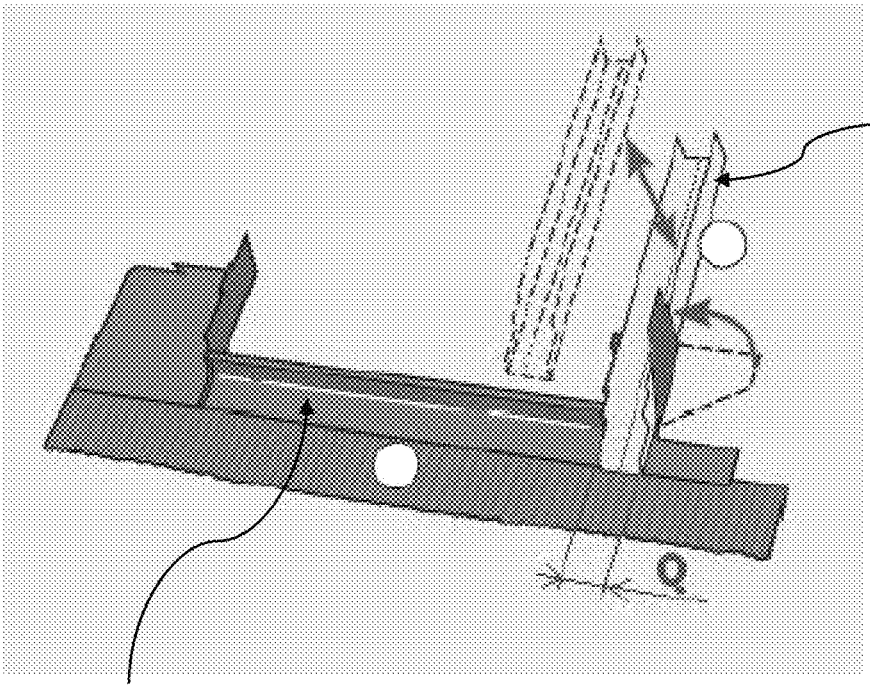
Figure 8:
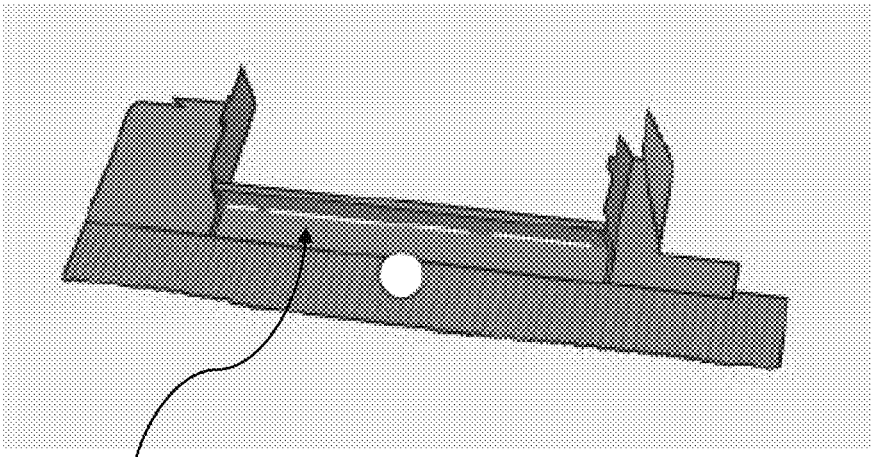
Figure 9:
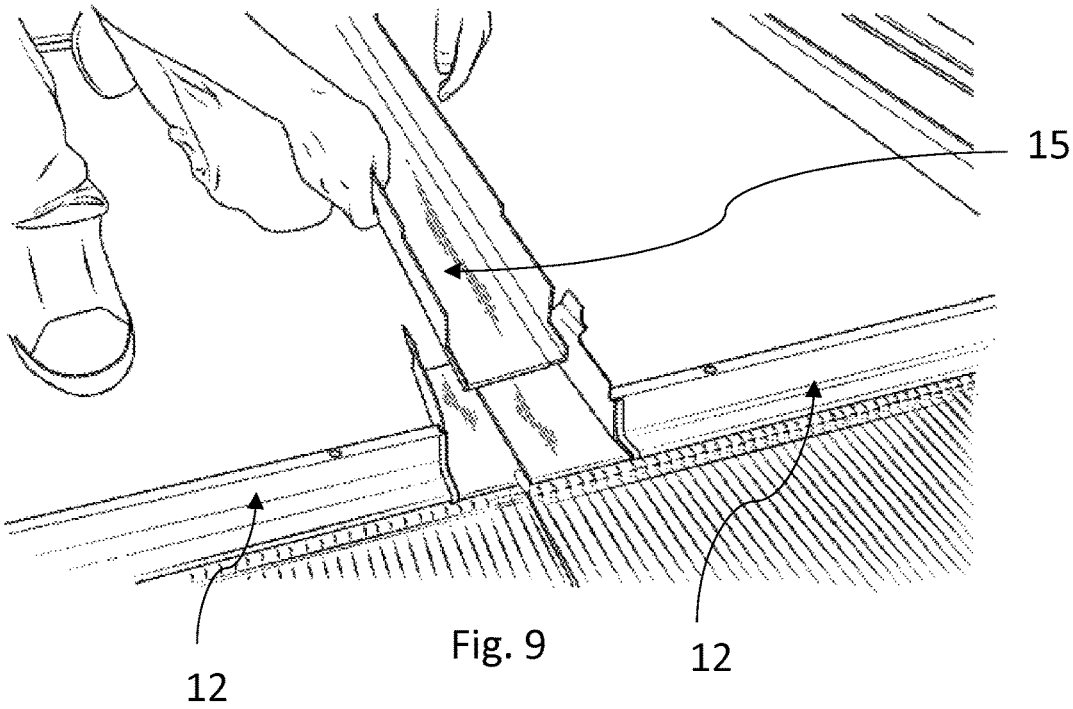
FIG. 9 shows a photograph showing a step of a method for mounting a flashing assembly where the flashing assembly is provided in an assembled state.

Referring now to FIG. 4, which shows the principles of the engagement between two flashing elements, the configuration of a flashing assembly 1 in an embodiment of the invention will be described. The flashing assembly 1 is intended for use between two roof windows 2, which are mounted side by side in an inclined roof structure 3 and which each comprises a frame and a pane element. Reference is also being made to FIG. 5 including the indication of the height direction H, the width direction W and the slope direction D. All directional axes are to be referenced to such directions.

The flashing assembly 1 comprises a first flashing element generally designated 7 and configured for extending along a frame member of the frame of a first roof window and a second flashing element generally designated 8 configured for extending along a frame member of the frame of a second roof window.

Each flashing element 7, 8 comprises a first section 71, 81 and a second section 72, 82. The first section 71, 81 extends along a width axis of the flashing element 7, 8 in the mounted state of the flashing assembly 1. Thus, the first section 71, 81 is configured for extending between the first roof window and the second roof window. Each first section 71, 81 has an interior side configured for facing the roof structure. Each second section 72, 82 extends in an exterior direction along a height axis of the flashing element 7, 8 in the mounted state. Correspondingly, each second section 72, 82 has an interior side configured for facing the frame of one of the roof windows, said second section having a first edge at the first section and a second edge located at distance from the first section measured along the height axis.

The first section 71 of the first flashing element 7 comprises two legs 711, 712 extending along the width axis and being located at a distance from each other measured along the height axis thereby forming a pocket 713 between them. As shown in the lower part of FIG. 4, the first section 81 of the second flashing element 8 fits into the pocket of the first flashing element.

Further details visible in the embodiment of the flashing assembly 1 shown in FIG. 4 include the feature that the one of the two legs 712 of the first section 71 of the first flashing element 7 located furthest from the second edge of the second section of the first flashing element has a flange 71*a* projecting along the height axis in an exterior direction away from the interior side of the first section toward the other of the two legs. Correspondingly, the first section 81 of the second flashing element has a flange 81*a* projecting along the height axis in an interior direction.

The flanges 71*a*, 81*a* of the flashing elements 7, 8 each extends at an angle of more than 90 degrees in relation to the width axis so that they project back towards the respective second sections 72, 82 of the flashing elements 7, 8.

The material of both flashing elements 7, 8 may be chosen arbitrarily but are in the embodiment shown made from sheet metal, preferably from aluminium or copper.

Suitable dimensions of the flashing elements of the flashing assembly are given in the following: Where the first section of the second flashing element has a width measured along the width axis from the second section to an edge opposite the second section, where the pocket of the first section of the first flashing element has a depth measured along the width axis from the second section to an edge of the shorter of the two legs, and where said width of the first section of the second flashing element is at least 1.1 times the depth of the pocket.

While reference numerals 7, 8 have been used to generally designate the first and second flashing elements, it is to be recognised that such flashing elements are generally applicable to flashing elements forming part of the flashing assembly 1.

Thus, the first and second flashing element may constitute side flashing elements configured for extending along a side frame member 23, 24 of the roof windows. In this way, these flashing elements, and hence the flashing assembly 1 formed by them, may replace middle gutter flashing elements 15 or side flashing elements 13, 14 of the prior art flashing assembly shown in FIGS. 1 and 2.

Additionally or alternatively, the first and second flashing element are top flashing elements configured for extending along top frame member 21 of the roof windows, bottom flashing elements configured for extending along bottom frame member 22 of the roof windows, or gutter flashing elements configured for use between roof windows arranged above each other. Comparing with the prior art flashing assembly, it is thus possible to apply the principles underlying the invention to the top flashing element 12, the bottom flashing element 13 and the drainage gutter element 18.

Referring now also to FIGS. 5-23, a method for mounting a flashing assembly between two roof windows which are mounted side by side in an inclined roof will be described.

The steps comprised by the method include:

arranging a first flashing element 7 of the middle gutter flashing element 15 so that it extends along a frame member of the frame 2 of a first roof window with a first section 71 extending between the two roof windows, with an interior side of the first section facing the roof structure, with a second section 72 extending along a height axis in an exterior direction, and with an interior side of the second section facing the frame of the first roof window, arranging a second flashing element 8 of the middle gutter flashing element 15 so that it extends along a frame member of the frame 2 of a second roof window with a first section 81 extending between the two roof windows, with an interior side of the first section facing the roof structure, with a second section 82 extending in an exterior direction, and with an interior side of the second section facing the frame of the second roof window, whereby the first section 81 of the second flashing element 8 is inserted into a pocket 713 of the first section 71 of the first flashing element 7, said pocket 713 being formed by two legs 711, 712 extending along a width axis and being located at a distance from each other measured along the height axis.

The method may be carried out such that the first section 81 of the second flashing element 8 is initially inserted fully into the pocket 713 of the first flashing element 7 (see, for example, FIG. 9), and where the flashing elements 7, 8 are subsequently pulled away from each other until the second sections 72, 82 of the flashing elements come into contact with the frames of the roof windows (see, for example, FIG. 10).

Figure 10:
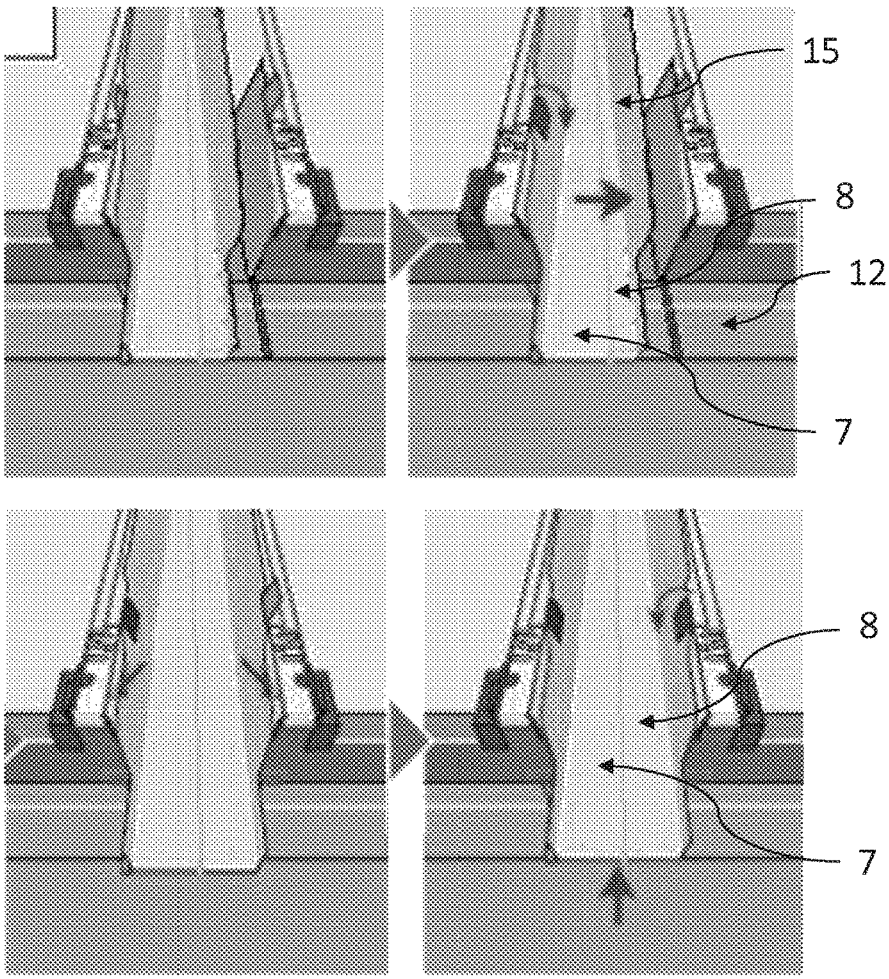
FIG. 10 are perspective views depicting steps in a method for mounting a flashing assembly where the flashing assembly is provided in an assembled state.

As is apparent from the illustrations, the first flashing element 7 is generally mounted, i.e., connected to a frame of a first window, before the second flashing element 8, i.e., connected to a frame of a second window (see, for example, FIG. 10, upper left image).

In some installation conditions, the first section of the second flashing element is bending during the insertion into the pocket.

To adjust the width to the desired dimension, the first section of the second flashing element may be inserted fully into the pocket of the first flashing element, and where the second flashing elements is subsequently pulled back until the second section of the second flashing element comes into contact with the frame of the second roof window.

Figure 11:
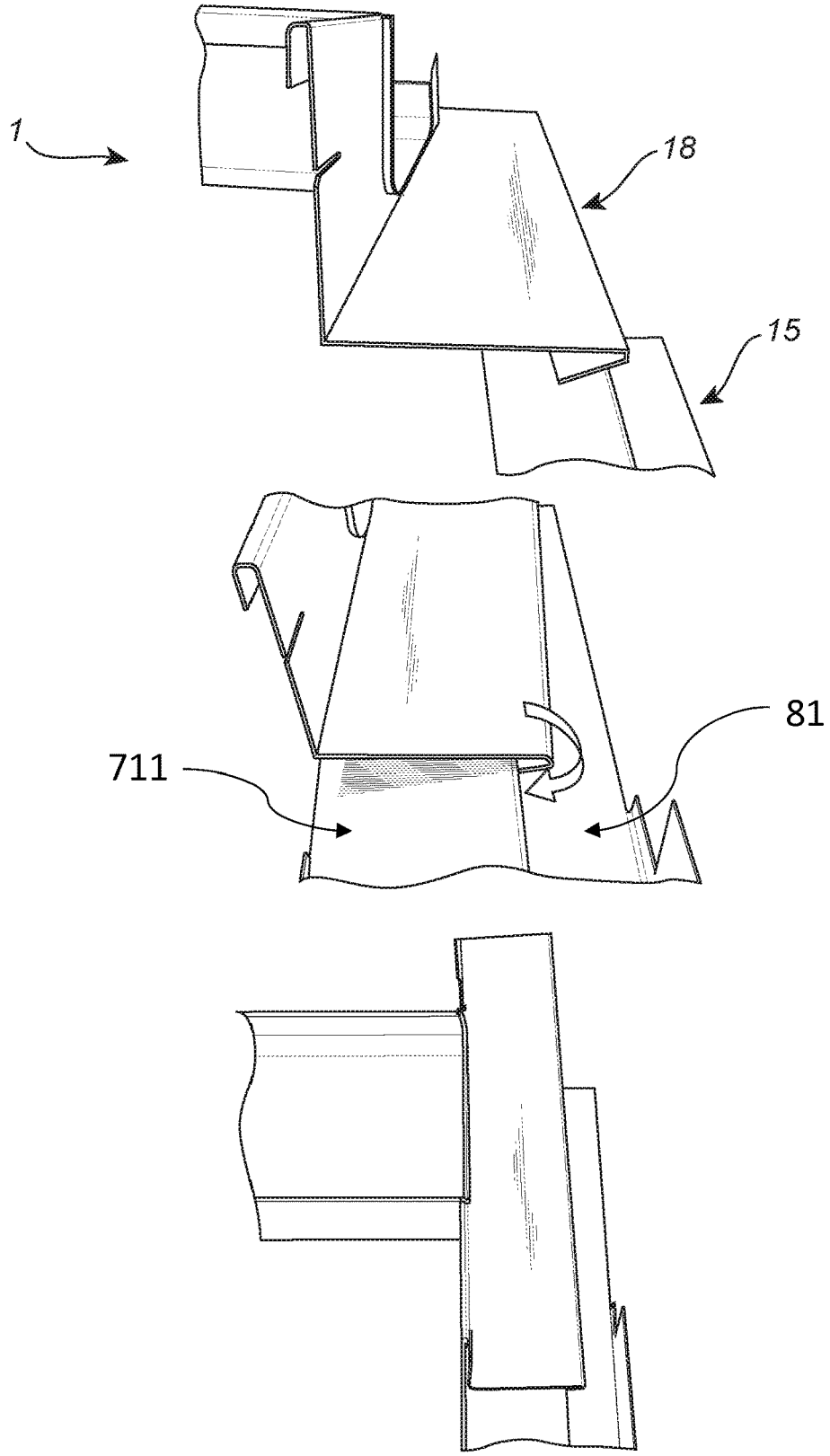
FIG. 11 shows sequential photographs depicting steps of a method for mounting a flashing assembly.
Figure 12:
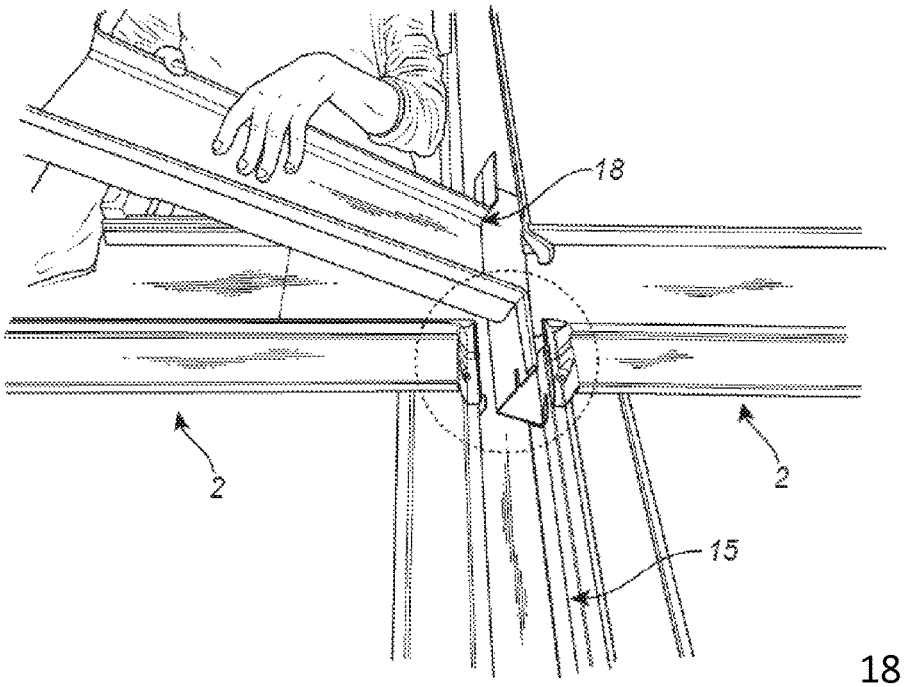
FIG. 12 shows a photograph depicting a step of a method for mounting a flashing assembly.
Figure 13:
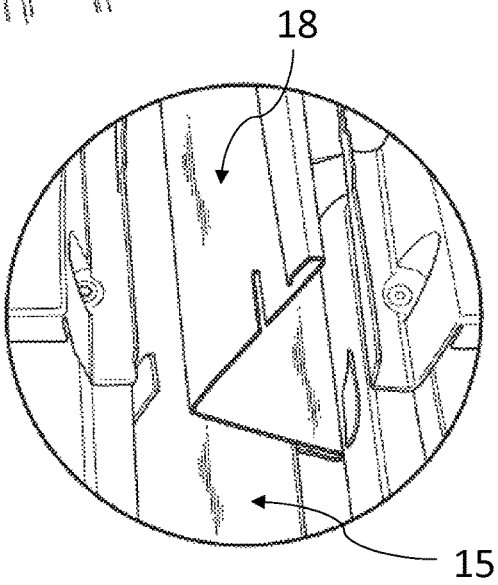
FIG. 13 shows a detail of FIG. 12.
Figure 14:
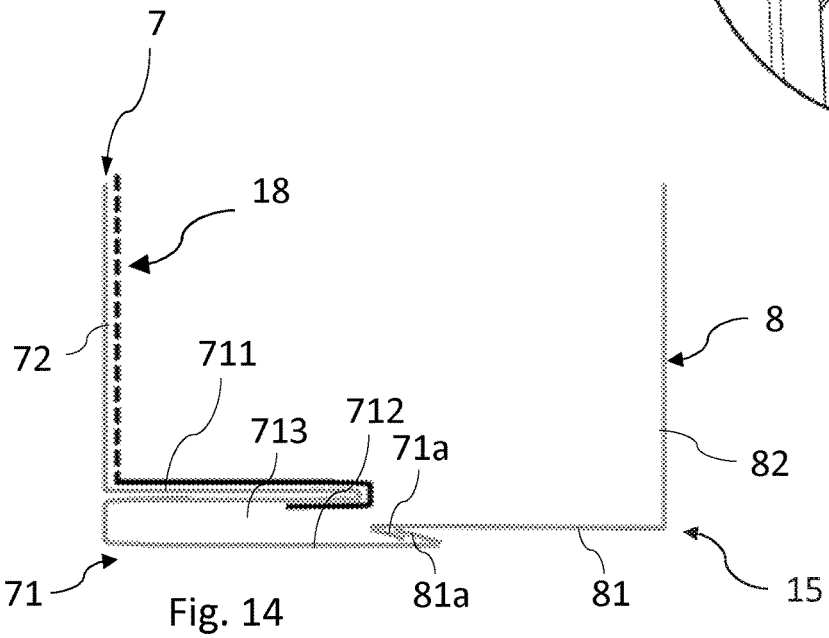
FIG. 14 is a view corresponding to FIG. 4, representing the attained step of a method for mounting a flashing assembly corresponding to FIG. 12.
Figure 15:
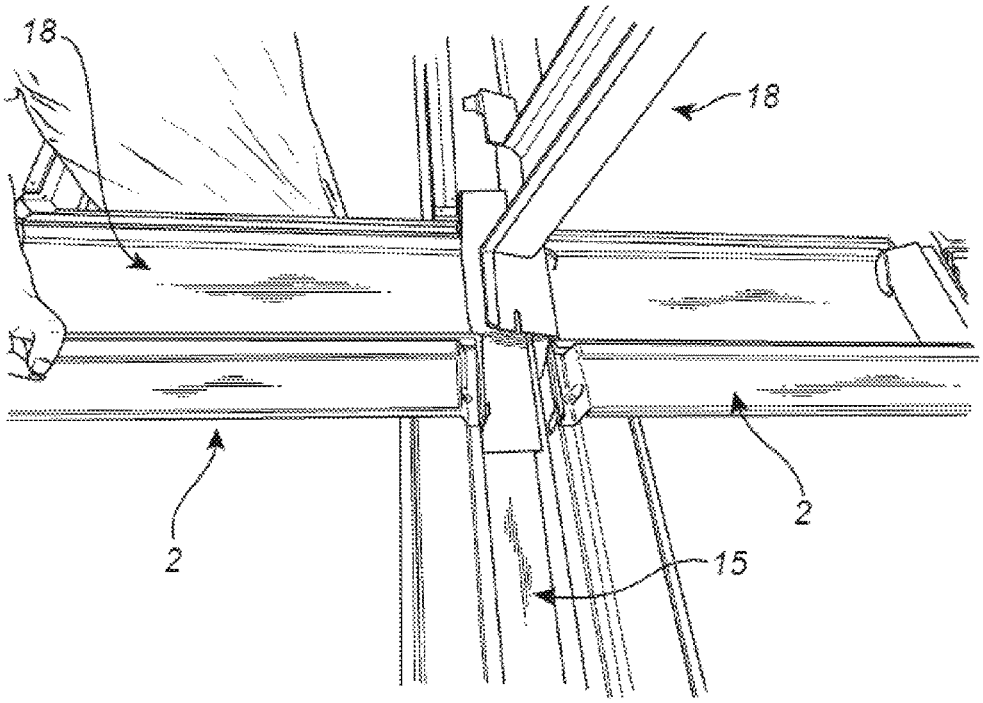
FIGS. 15 and 16 show sequential photographs depicting steps in a method for mounting a flashing assembly.

In FIGS. 11-14 a left-hand drainage gutter element 18 is attached to the middle gutter flashing element 15 shown in FIGS. 5-10 by hooking onto the upper leg 711 of the two legs forming the pocket 713 as best seen in FIGS. 11 and 14.

Figure 16:
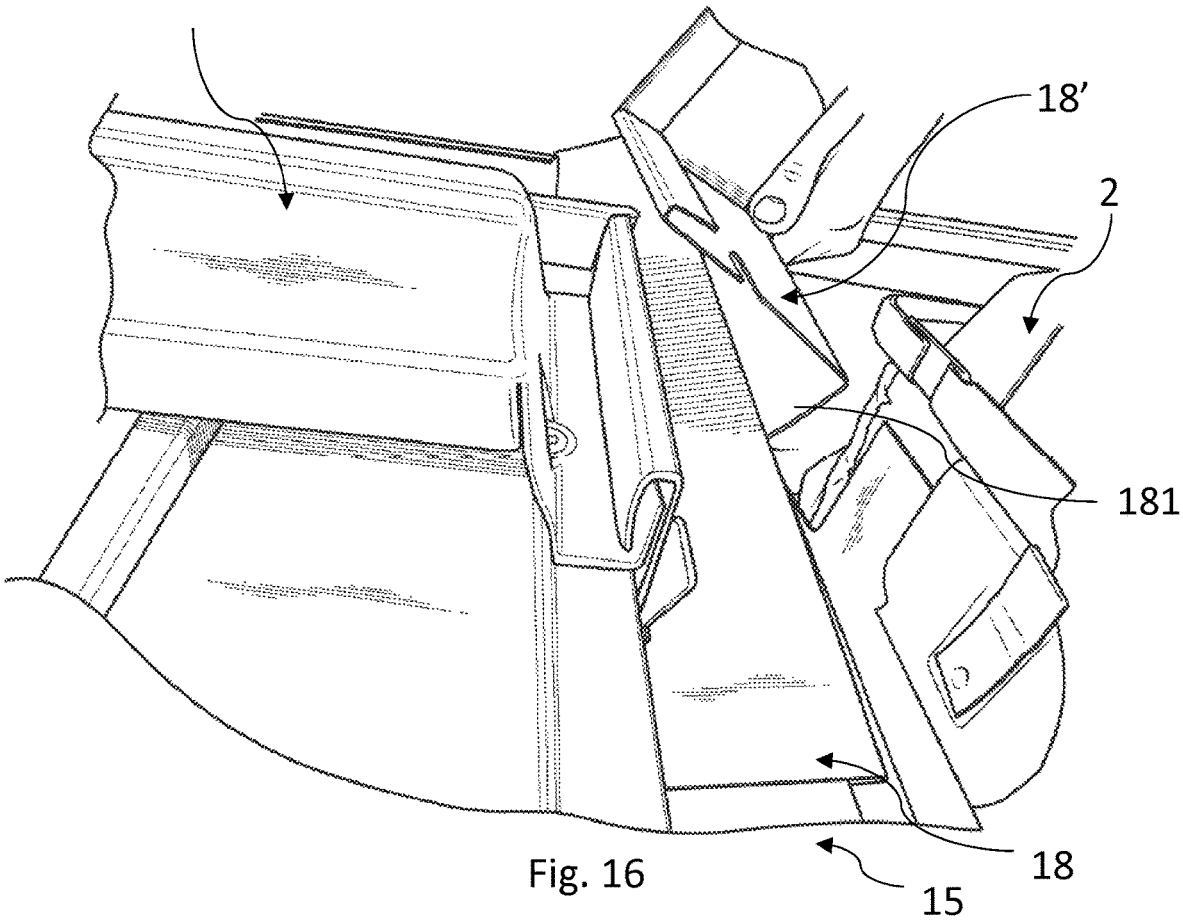
Figure 17:
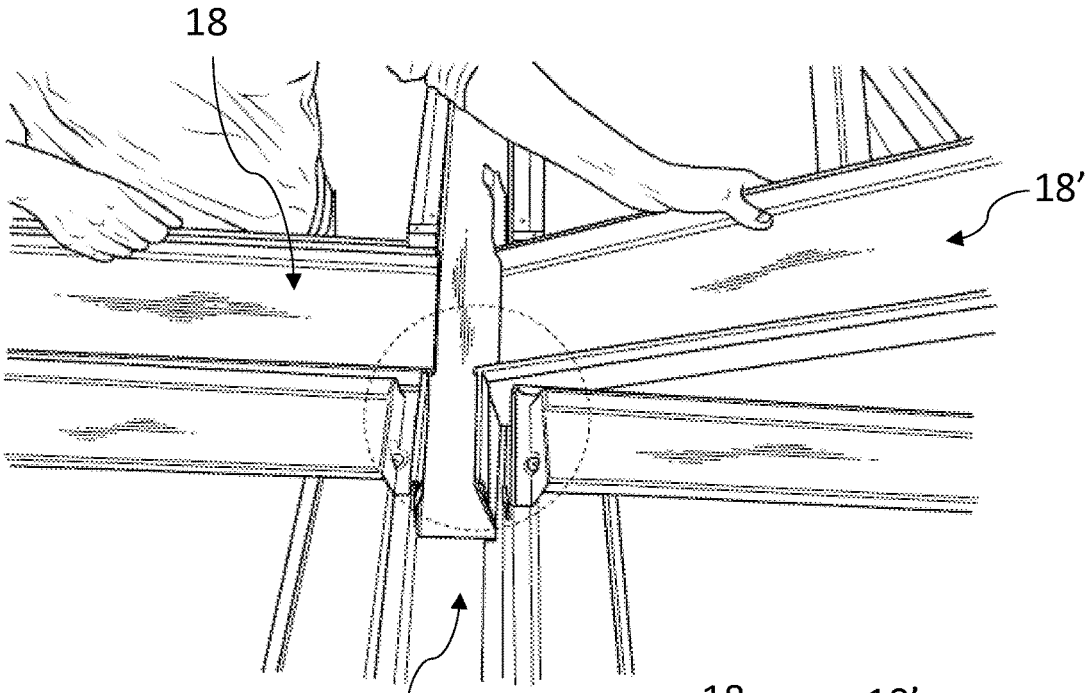
FIG. 17 shows a photograph depicting a step of a method for mounting a flashing assembly.
Figure 18:
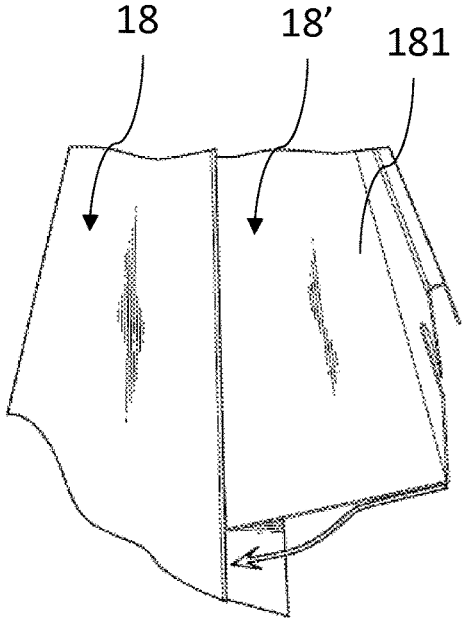
FIG. 18 shows a photograph of a detail corresponding to the step FIG. 17.
Figure 19:
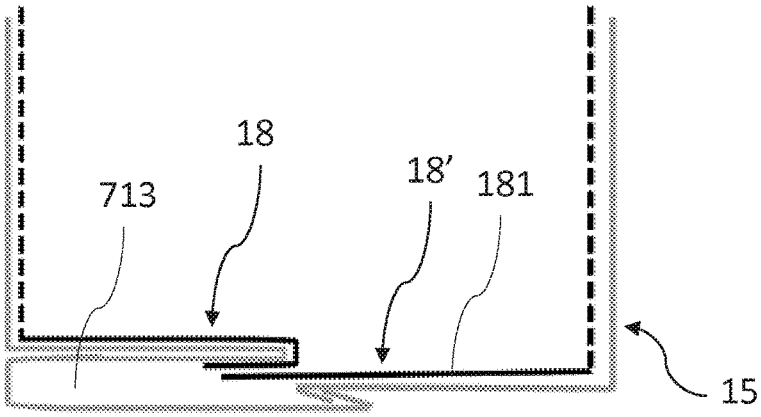
FIG. 19 is a view corresponding to FIG. 4 and FIG. 14, representing the attained step of a method for mounting a flashing assembly corresponding to FIG. 17.

In FIGS. 15-19 a right-hand drainage gutter element 18' is attached to the middle gutter flashing element 15 shown in FIGS. 5-10 by inserting the first section 181 into the pocket 713 as best seen in FIGS. 18-19. During the insertion into the pocket, the first section is bending as best seen in FIG. 16.

Figure 20:
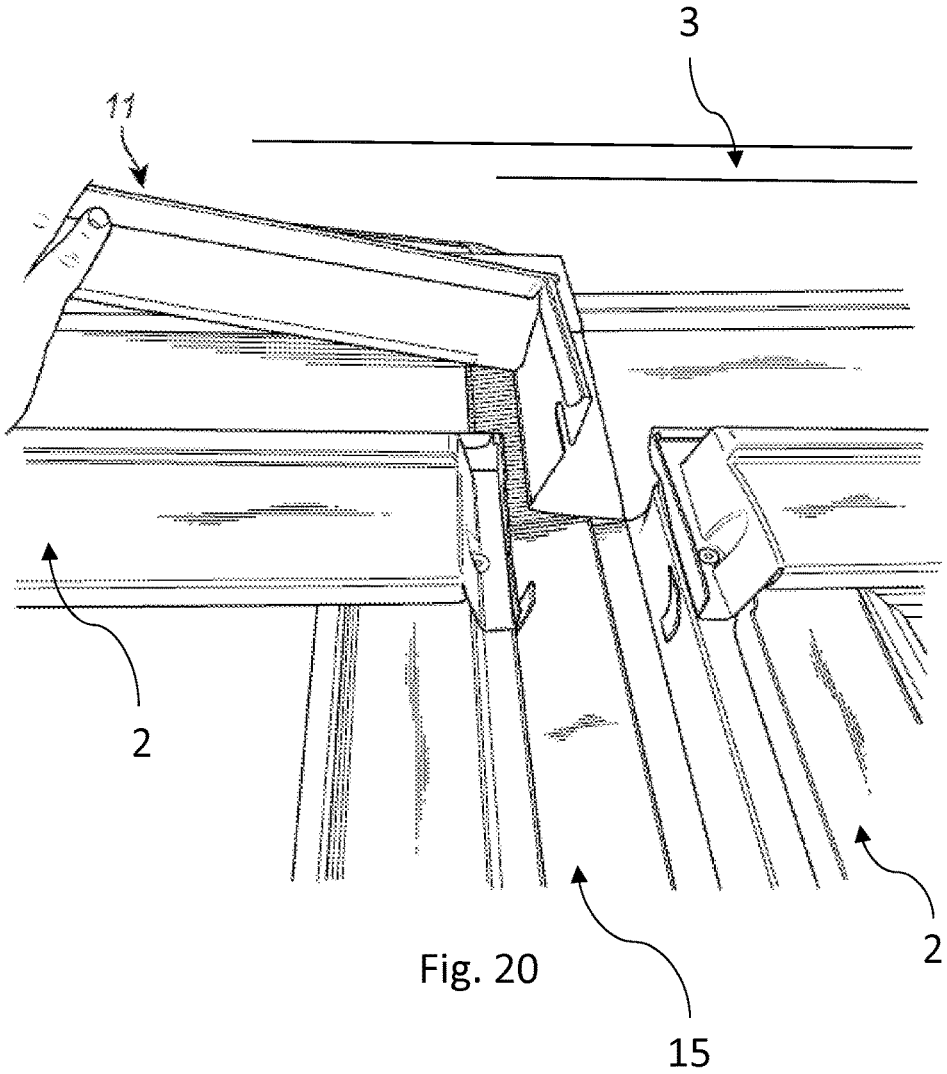
FIG. 20 shows a photograph depicting a step of a method for mounting a flashing assembly.
Figure 21:
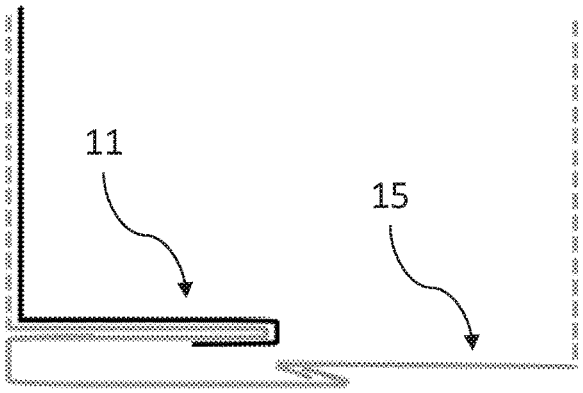
FIG. 21 is a view corresponding to FIGS. 4, 14 and 19, representing the attained step of a method for mounting a flashing assembly corresponding to FIG. 20.
Figure 22:
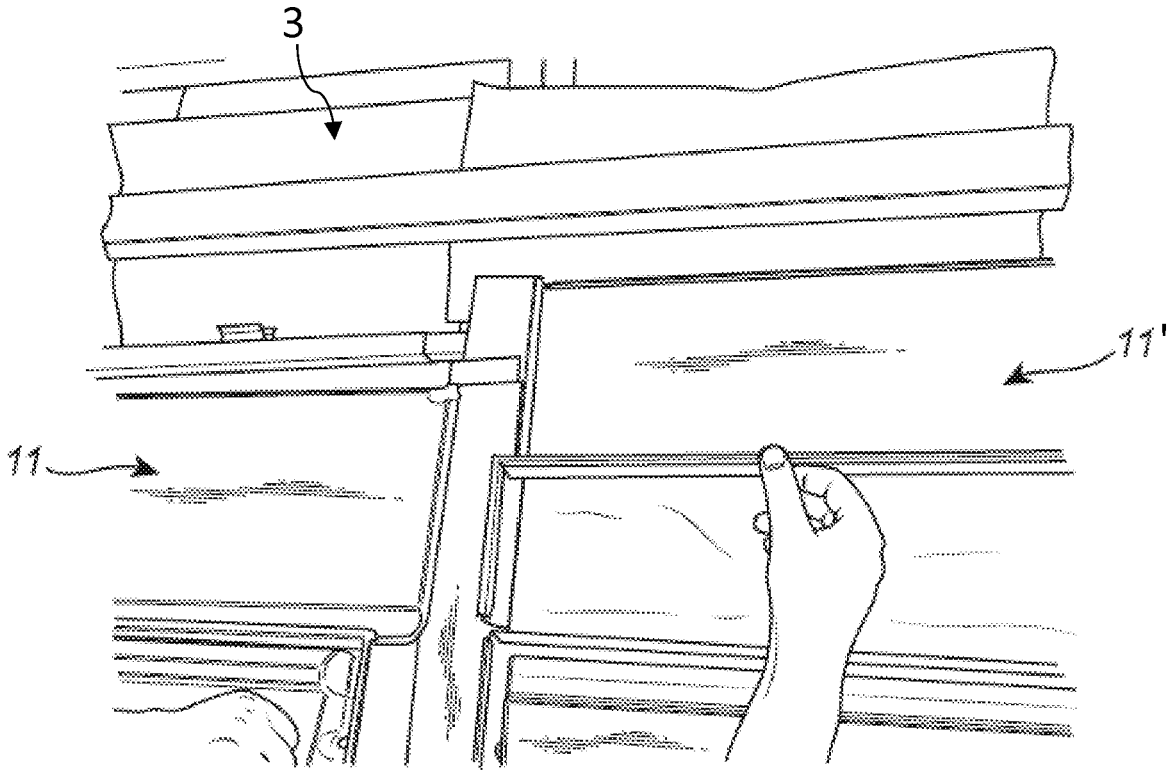
FIG. 22 shows a photograph depicting a step of a method for mounting a flashing assembly.
Figure 23:
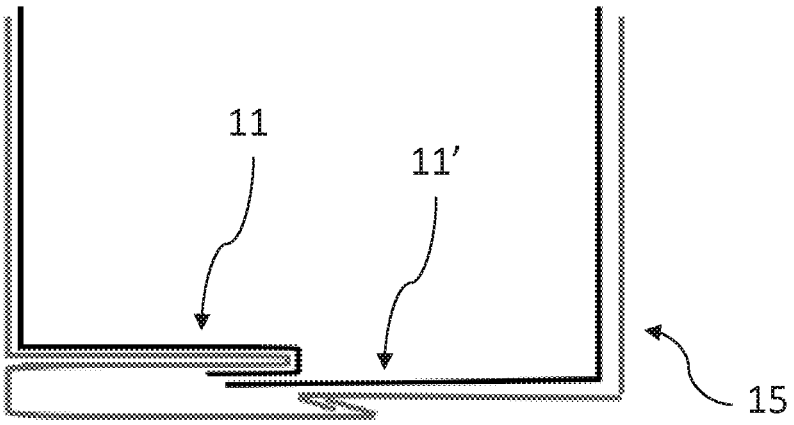
FIG. 23 is a view corresponding to FIGS. 4, 14, 19 and 21, representing the attained step of a method for mounting a flashing assembly corresponding to FIG. 22.

FIGS. 20-21 show the mounting of a left-hand top flashing elements 11, which is interconnected with a middle gutter flashing element 15 in the same way as described for the left-hand drainage gutter element 18 in FIGS. 11-14, and FIGS. 22-23 show the mounting of a right-hand top flashing elements 11' in the same way as described for the right-hand drainage gutter element 18' in FIGS. 15-19.

LIST OF REFERENCE NUMERALS

1 flashing assembly
2 frame
  21 top frame member
  22 bottom frame member
  23 side frame member
  24 side frame member
3 roof structure
7 first flashing element
  71 first section
  71*a* flange
  711 leg
  712 leg
  713 pocket
  72 second section
8 second flashing element
  81 first section
  81*a* flange
  82 second section
11 top flashing element
  111 outer portion
  112 inner portion
  113 corner section
  114 corner section
12 bottom flashing element
  121 outer portion
  122 inner portion
  123 corner section
  124 corner section
13 side flashing element
  131 outer portion
  132 inner portion
14 side flashing element
  141 outer portion
  142 inner portion
15 middle gutter flashing element
16 cover member
17 cover member
18 drainage gutter element
D slope direction
W width direction
H height direction

The invention claimed is:

1. A flashing assembly for use between two roof windows, which are mounted side by side in an inclined roof structure and which each comprises a frame and a pane element, said flashing assembly comprising a first flashing element configured for extending along a frame member of the frame of a first roof window and a second flashing element configured for extending along a frame member of the frame of a second roof window, each of the first flashing element and the second flashing element comprising a first section and a second section, said first section extending along a width axis of a corresponding flashing element, being configured for extending between the first roof window and the second roof window, and having an interior side configured for facing the inclined roof structure, and said second section extending in an exterior direction along a height axis of a corresponding flashing element and having an interior side configured for facing the frame of one of the first and second roof windows, said second section having a first edge at the first section and a second edge located at a distance from the first section measured along the height axis, the first section of the first flashing element comprises two legs extending along the width axis and being located at a distance from each other measured along the height axis thereby forming a pocket between the two legs, and that the first section of the second flashing element fits into the pocket of the first flashing element.

2. The flashing assembly according to claim 1, where the one of the two legs of the first section of the first flashing element located furthest from the second edge of the second section of the first flashing element has a flange projecting along the height axis in an exterior direction away from the interior side of the first section toward the other of the two legs, and where the first section of the second flashing element has a flange projecting along the height axis in an interior direction.

3. The flashing assembly according to claim 2, where the flanges of the first and second flashing elements each extends at an angle of more than 90 degrees in relation to the width axis so that they project back towards the second section of a corresponding flashing element.

4. The flashing assembly according to claim 1, where both of the first and second flashing elements are made from sheet metal.

5. The flashing assembly according to claim 1, where the first and second flashing elements are side flashing elements configured for extending along a side frame member of a corresponding roof window.

6. The flashing assembly according to claim 1, where the first and second flashing elements are one of the following: (i) top flashing elements configured for extending along a top frame member of a corresponding roof window, (ii) bottom flashing elements configured for extending along a bottom frame member of a corresponding roof window, and (iii) gutter flashing elements configured for use between roof windows arranged above each other.

7. The flashing assembly according to claim 1, where a first leg of the two legs extends along the width axis a distance less than a second leg of the two legs, where the first section of the second flashing element has a width measured along the width axis from the second section to an edge opposite the second section, where the pocket of the first section of the first flashing element has a depth measured along the width axis from the second section to an edge of the first leg of the two legs, and where said width of the first section of the second flashing element is at least 1.1 times the depth of the pocket.

8. A group of roof windows including at least two roof windows mounted side by side in an inclined roof structure using a flashing assembly according to claim 1.

9. The group of roof windows according to claim 8, where the total width of the first sections of the two flashing elements when the first section of the second flashing element is inserted fully into a pocket of the first section of the first flashing element is smaller than the distance between the two roof windows.

10. A method for mounting a flashing assembly between two roof windows, which are mounted side by side in an inclined roof structure and which each comprises a frame and a pane element, said method comprising:

arranging a first flashing element so that it extends along a frame member of the frame of a first roof window with a first section extending between the two roof windows, with an interior side of the first section facing the inclined roof structure, with a second section extending along a height axis in an exterior direction, and with an interior side of the second section facing the frame of the first roof window, arranging a second flashing element so that it extends along a frame member of the frame of a second roof window with a first section extending between the two roof windows, with an interior side of the first section facing the inclined roof structure, with a second section extending in an exterior direction, and with an interior side of the second section facing the frame of the second roof window, wherein the first section of the second flashing element is inserted into a pocket of the first section of the first flashing element, said pocket being formed by two legs extending along a width axis and being located at a distance from each other measured along the height axis.

11. The method according to claim 10, where the first section of the second flashing element is initially inserted fully into the pocket of the first flashing element, and where the flashing elements are subsequently pulled away from each other until the second sections of the first and second flashing elements come into contact with the frame of a corresponding roof window.

12. The method according to claim 11, where the first flashing element is mounted before the second flashing element.

13. The method according to claim 10, where, during the insertion into the pocket, the first section of the second flashing element is bending.

14. The method according to claim 10, where the first section of the second flashing element is inserted fully into the pocket of the first flashing element, and where the second flashing element is subsequently pulled back until the second section of the second flashing element comes into contact with the frame of the second roof window.

15. The flashing assembly according to claim 4, where both of the first and second flashing elements are made from aluminium or copper.

16. The flashing assembly according to claim 2, where the first and second flashing elements are side flashing elements configured for extending along a side frame member of a corresponding roof window.

17. The flashing assembly according to claim 2, where the first and second flashing elements are one of the following: (i) top flashing elements configured for extending along a top frame member of a corresponding roof window, (ii) bottom flashing elements configured for extending along a bottom frame member of a corresponding roof window, and (iii) gutter flashing elements configured for use between roof windows arranged above each other.

18. A group of roof windows including at least two roof windows mounted side by side in an inclined roof structure using a flashing assembly according to claim 2.

19. A group of roof windows including at least two roof windows mounted side by side in an inclined roof structure using a flashing assembly according to claim 3.

20. A group of roof windows including at least two roof windows mounted side by side in an inclined roof structure using a flashing assembly according to claim 5.

* * * * *